US005330202A

United States Patent [19]

Kimberlin et al.

[11] Patent Number: 5,330,202

[45] Date of Patent: Jul. 19, 1994

[54] TOOL RETAINER FOR A PERCUSSIVE, FLUID-ACTIVATED APPARATUS

[75] Inventors: Robert R. Kimberlin; Steven W. Bodell, both of Troutville, Va.

[73] Assignee: Ingersoll-Rand Company, Woodcliff Lake, N.J.

[21] Appl. No.: 958,377

[22] Filed: Oct. 8, 1992

[51] Int. Cl.[5] ..... B25D 17/08

[52] U.S. Cl. ..... 279/19.1; 274/157

[58] Field of Search ..... 279/19.1, 157, 19.2, 279/145; 408/14

[56] References Cited

U.S. PATENT DOCUMENTS

| | | | |
|---|---|---|---|
| 1,440,075 | 12/1922 | Halvorsen | 279/19.1 |
| 1,517,479 | 12/1924 | Wilhelm | 279/19.1 |
| 1,671,133 | 5/1928 | Slater | 279/19.1 |
| 1,712,239 | 5/1927 | Wilhelm | 279/19.1 |
| 1,800,377 | 12/1928 | Downing | 279/19.1 |
| 1,841,953 | 10/1927 | Hultquist | 279/19.1 |
| 1,905,981 | 5/1931 | Curtis | 279/19.1 |
| 2,122,516 | 8/1935 | Curtis et al. | 279/19.1 |
| 2,182,365 | 8/1937 | Smith, Sr. | 279/19.1 |
| 2,489,923 | 11/1949 | Nast | 279/19.1 |
| 2,500,038 | 3/1950 | Lear | 279/19.1 |
| 2,579,075 | 12/1951 | Hirschberg | 173/133 X |
| 2,604,328 | 7/1952 | Feucht | 279/19.1 |
| 2,817,316 | 12/1957 | Ekstrom | 279/19.1 |
| 2,958,534 | 11/1960 | Fuehrer | 279/19.1 |
| 3,010,431 | 11/1961 | Holdo | 279/19.1 X |
| 3,499,656 | 3/1970 | Calmusky | 279/19.1 |
| 3,865,198 | 2/1975 | Price | 279/19.1 X |

OTHER PUBLICATIONS

Ingersoll-Rand Company, JH40 "Jackhamer", Aug. 1, 1985.

*Primary Examiner*—Z. R. Bilinsky

*Attorney, Agent, or Firm*—John J. Selko

[57] ABSTRACT

A drill steel retainer for a jackhammer includes a latch pivotally mounted on the front head of the jackhammer, a detent mechanism for retaining the latch in a tool retaining and tool releasing position, and a stop member on the fronthead for insuring spacing between a work surface and the latch, whereby the latch can be pivoted by the operator at all times. Elastic shock absorber members are included in the latch.

3 Claims, 3 Drawing Sheets

TOOL RETAINER FOR A PERCUSSIVE, FLUID-ACTIVATED APPARATUS

BACKGROUND OF THE INVENTION

This invention relates generally to a tool retainer for a percussive, fluid-activated apparatus, and more particularly to a latch for retaining a drill steel in a jackhammer.

Current jackhammer latches involve complicated, pivotal assemblies on a fronthead of the jackhammer. If the drill steel penetrates too deeply into a work surface, the drill steel can become jammed therein, with the fronthead of the jackhammer forced against the work surface. This condition can cause such latches to become not operable because they cannot pivot due to the proximity of the work surface.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a tool retainer having a pair of support arms connected to a fronthead, a latch pivotally mounted on the arms, a detent in the latch for retaining the latch in a tool retaining or tool releasing position, and a stop structure on the fronthead to contact the work surface, to provide clearance between the latch and the work surface, so that the latch can be pivoted by the operator at all times.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
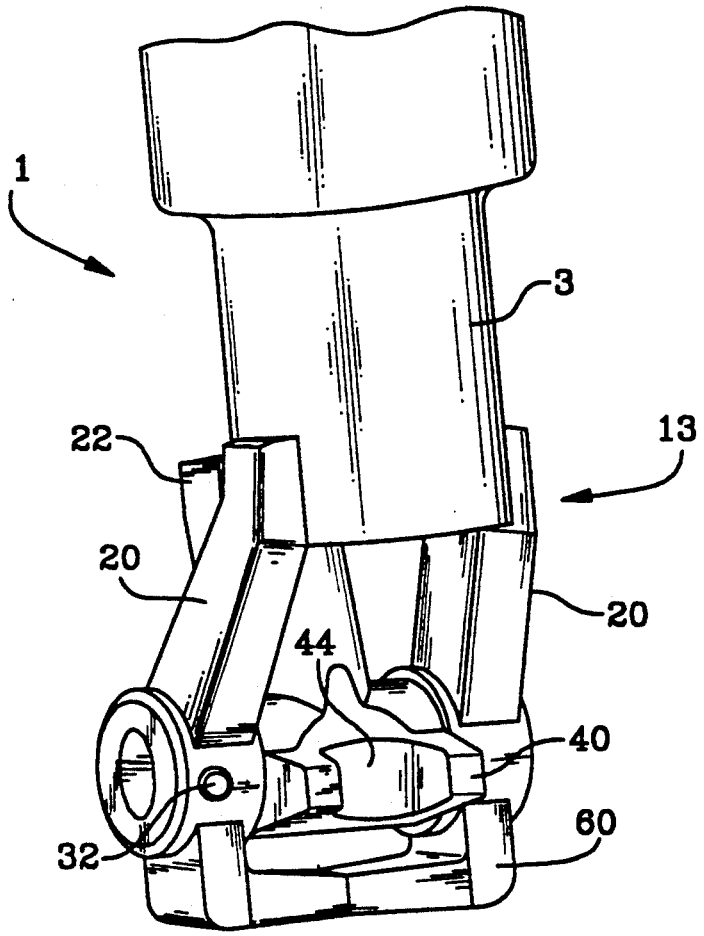
FIG. 1 is an isometric schematic view of the fronthead of a jackhammer having the latch of the invention thereon.
Figure 4:
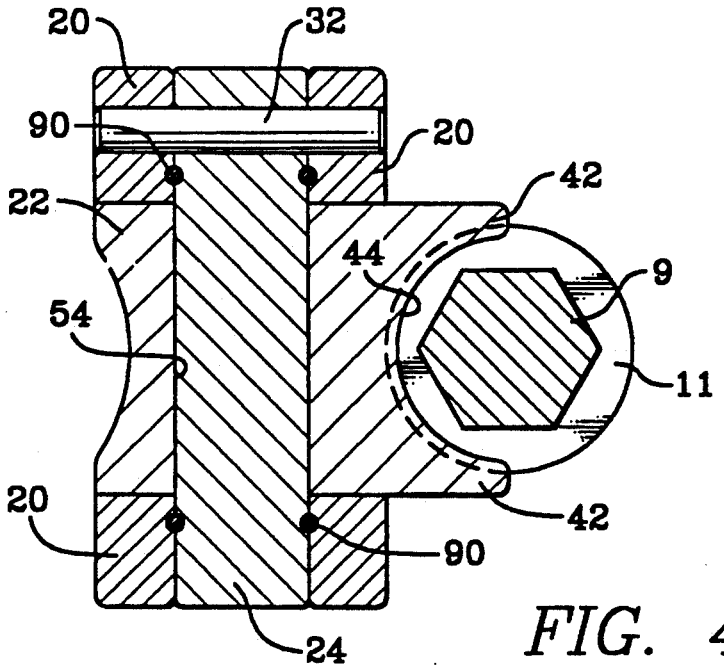
FIG. 4 is a view, in partial cross section, with parts removed, along 4—4 of FIG. 3.

Referring to the drawings, Jackhammer 1 has front head 3 with chuck 5 therein. Removably positioned in chuck 5 along longitudinal axis 7 of fronthead 3 is a tool 9, in this case a drill steel, having a collar 11 thereon, as is well known. Tool 9 is retained in position by retainer, shown generally as 13 (FIG. 1). Retainer 13 comprises a pair of spaced-apart support arms 20 connected to fronthead 3, and extending downwardly and outwardly from fronthead 3. Arms 20 terminate in a position that is alongside longitudinal axis 7.

Figure 2:
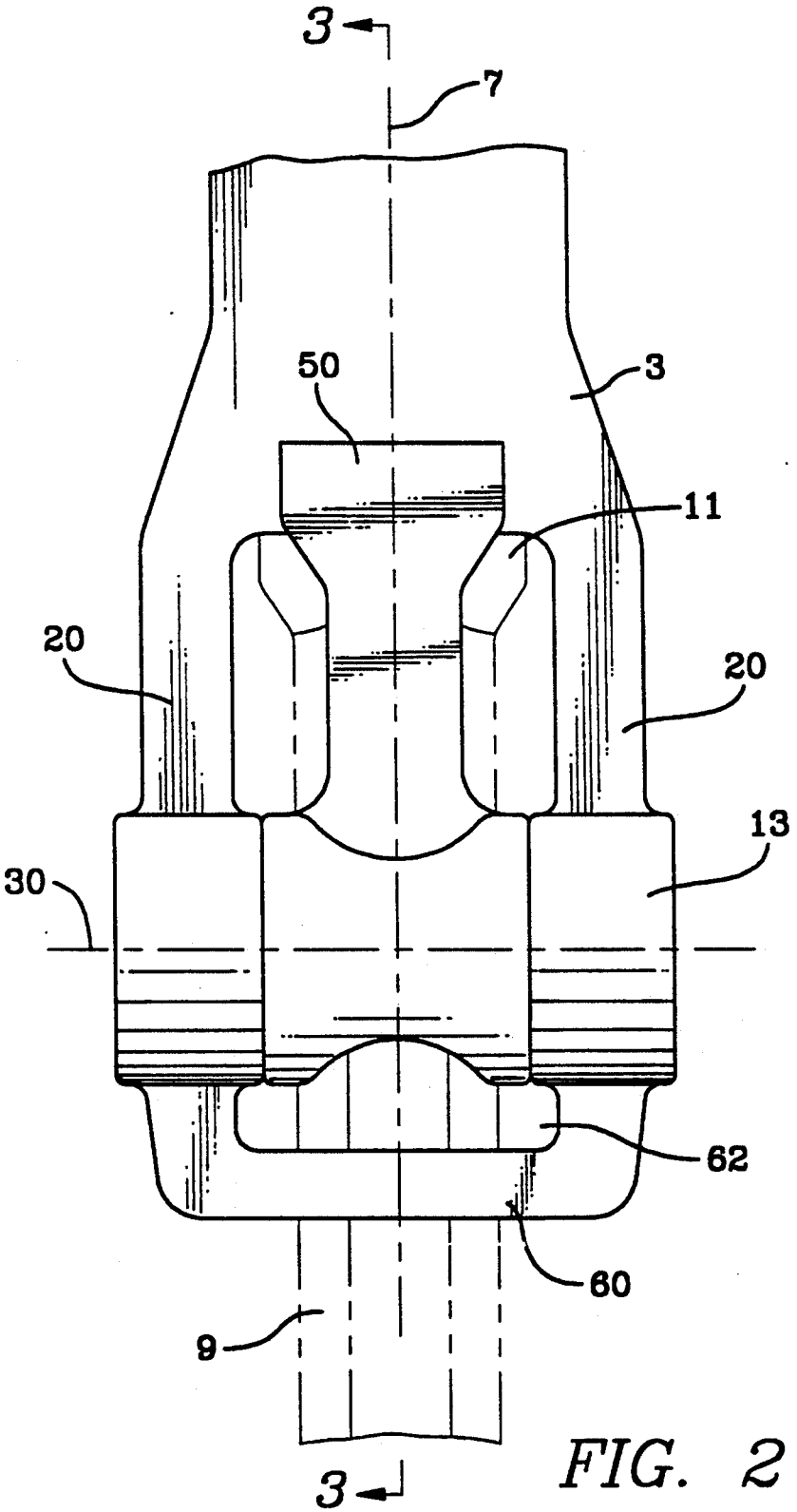
FIG. 2 is a schematic elevational front view, with parts removed, of a jackhammer with the latch of the invention thereon, with a drill steel shown in dotted.
Figure 3:
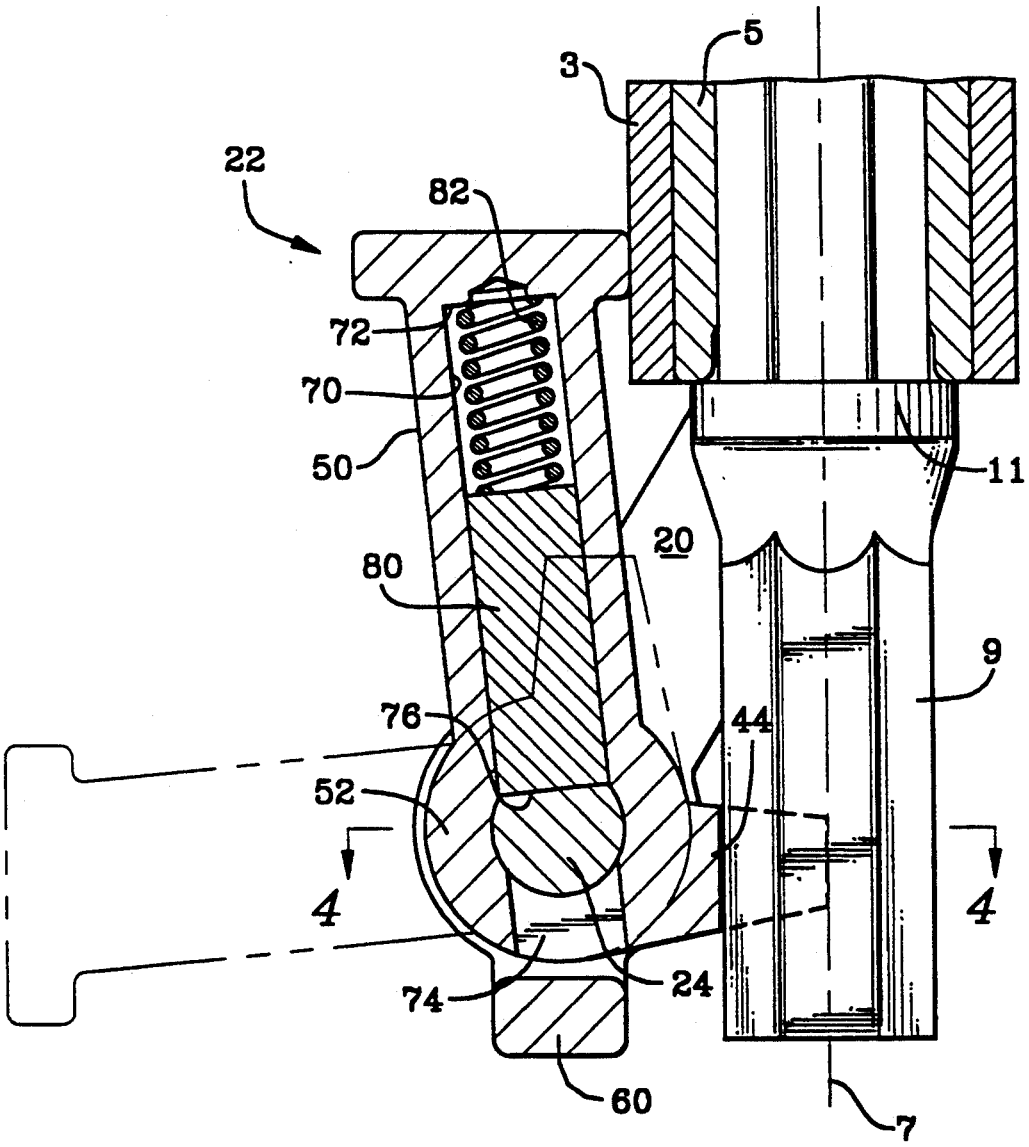
FIG. 3 is a view, in partial cross section, with parts removed, along 3—3 of FIG. 2.

As shown in FIGS. 2 and 3, a latch means 22 is pivotally mounted between arms 20 for pivoting between a tool retaining position and a tool releasing position, as described hereinafter. Latch means 22 includes a pivot pin 24 extending between arms 20, with pivot pin 24 being fixed in arms 20 against rotation, and having an axis 30 that is transverse to axis 7 (FIG. 2). The term "transverse" herein means in a plane that is perpendicular to axis 7, when viewed from a front elevational view, as in FIG. 2. Pivot pin 24 is fixed against rotation by anchor pin 32 that extends through both pivot pin 24 and at least one arm 20.

Latch means 22 further includes a yoke 40 for engaging collar 11. Yoke 40 includes a pair of parallel arms 42 that extend outwardly and form a bight portion 44 to partially surround drill steel 9. Bight portion 44 engages collar 11, when latch 22 is in the tool retaining position, because bight 44 is of a smaller radius of curvature than that included on collar 11, as is well known.

Handle 50 is angularly disposed with respect to yoke 40, at an angle of about 90 degrees. Pivot housing 52 connects yoke 40 and handle 50, with housing 52 having a longitudinal bore 54 extending completely therethrough. Housing bore 54 is pivotally telescoped onto pivot pin 24. As shown in FIG. 3, latch 22 pivots between a tool retaining position and a tool releasing position, shown in phantom.

As shown in FIG. 2, spaced below latch 22 is a stop member 60, the purpose of which is to contact a work surface, if the drill steel is driven too deeply and becomes jammed. Stop member 60 provides a space 62 for the latch 22 to be rotated to the tool release position, thereby permitting the operator to withdraw the apparatus from the drill steel 9, and to use other devices to extract the drill steel 9. Stop structure 60 is preferred to be in the form of a stirrup extending parallel to axis 30 of pivot pin 24. Stop member 60 is formed by a cross member rigidly fixed between arms 20.

The latch 22 is provided with a detent means to help it remain in the tool retaining position. The detent means includes a bore 70 in handle 50 terminating in a closed top end 72 and an open bottom end 74, said open bottom end 74 opening into housing bore 54. A flat surface 76 is formed on pivot pin 24, with flat surface 76 being positioned along the length of pivot pin 24 so that open bottom 74 of bore 72 passes over flat surface 76, when latch 22 is pivoted. A plunger pin 80 is slidably mounted in bore 72 with a spring 82 for biasing plunger pin 80 into contact with pivot pin 24 at all times.

It is preferred that when the latch is assembled onto the fronthead, flat surface 76 be positioned below open end 74 of handle bore 72, with the handle in the vertical, or tool retaining position. This provides positive holding of the latch 22 in the tool retaining position.

In order to reduce shock from the operation of the apparatus, elastic o-rings 90 are positioned between pivot pin 24 and arms 20 in suitable grooves, in both pivot pin 24 and arms 20. The elastic material should be a polyurethane material having a Shore A Durometer of 90, plus or minus 5.

Having described the invention, what is claimed is:

1. In a percussive, fluid-activated apparatus having a fronthead and a collared working tool supported therein along a longitudinal fronthead axis, said tool for penetrating a work surface, a retainer for said tool comprising:

a. a pair of spaced-apart support arms extending outwardly from said fronthead to a position alongside said longitudinal axis;

b. latch means pivotally mounted between said arms for pivoting between a tool retaining position and a tool releasing position;

c. detent means for retaining said latch means in a tool retaining position and a tool releasing position, respectively;

d. stop means spaced below said latch means for contacting said work surface to provide clearance between said latch means and said work surface, whereby said latch means can be pivoted by an operator at all times;

e. said latch means further comprising:

i. a pivot pin extending between said support arms, said pivot pin being fixed from rotation with respect to said support arms, and having an axis transverse to said longitudinal axis;

ii. yoke means for engaging said tool collar;

iii. a handle angularly positioned with respect to said yoke means; and iv. a pivot housing connecting said yoke means and said handle, said housing having a bore therethrough pivotally mounted on said pivot pin; and f. elastic O-ring means positioned between said pivot pin and said support arms, said O-ring means being positioned in grooves in said pivot pin and said arms, said O-ring means being not in contact with said pivot housing, whereby said O-ring means are free from pivotable wear against said housing, as said housing pivots, while being positioned for absorbing shock.

2. The retainer of claim 1 wherein said detent means comprises:

a. a bore in said handle, said handle bore terminating in said handle in a closed top end and an open bottom end, said open bottom end intersecting said pivot housing bore;

b. a flat surface on said pivot pin, positioned along the length thereof, whereby said open bottom end of said handle bore passes over said flat surface, when said latch is pivoted; and c. means in said bore for biasing a plunger pin against said pivot pin.

3. The retainer of claim 2 wherein said detent means further comprises: said flat surface being positioned below said open bottom end of said handle bore, when said latch is in the tool retaining position.

* * * * *